United States Patent [19]

Coalier et al.

[11] Patent Number: 4,932,930

[45] Date of Patent: Jun. 12, 1990

[54] METHOD AND MACHINE FOR FORMING CASES WITH POLYGONAL SECTION MADE FROM A SHEET MATERIAL AND CASES THUS OBTAINED

[75] Inventors: Guy Coalier, Noce; Jean-Claude Serre, Beaune, both of France

[73] Assignee: Embal-Systems, Paris, France

[21] Appl. No.: 321,562

[22] Filed: Mar. 9, 1989

[30] Foreign Application Priority Data

Mar. 22, 1988 [FR] France ..... 88 03719

[51] Int. Cl.[5] ..... B31B 3/28; B31B 3/62

[52] U.S. Cl. ..... 493/128; 493/127; 493/176; 493/295; 493/472

[58] Field of Search ..... 493/125, 127, 128, 175, 493/176, 295, 472

[56] References Cited

U.S. PATENT DOCUMENTS

| | | | |
|---|---|---|---|
| 1,702,204 | 2/1929 | Phillips | 493/175 |
| 1,799,845 | 4/1931 | Gangler | 493/472 |
| 2,168,543 | 8/1939 | Vergobbi | 93/44.1 |
| 2,171,418 | 8/1939 | Palmer | 93/44 |
| 2,533,642 | 12/1950 | Vergobbi | 493/176 |
| 3,342,115 | 9/1967 | Reinecke | 493/472 |
| 4,123,966 | 11/1978 | Buschor | 493/127 |
| 4,242,949 | 1/1981 | Auckenthaler | 493/295 |
| 4,308,020 | 12/1981 | Langen | 493/175 |
| 4,708,706 | 11/1987 | Doderer et al. | 493/295 |

FOREIGN PATENT DOCUMENTS

| | | | |
|---|---|---|---|
| 098904 | 1/1984 | European Pat. Off. | 493/127 |
| 548092 | 3/1932 | Fed. Rep. of Germany | 493/175 |
| 1059830 | of 1959 | Fed. Rep. of Germany . | |
| 3541821 | of 1987 | Fed. Rep. of Germany . | |
| 1051421 | of 1953 | France . | |
| 190775 | of 1922 | United Kingdom . | |

*Primary Examiner*—William Terrell

*Attorney, Agent, or Firm*—Fisher, Christen & Sabol

[57] ABSTRACT

A method and machine for forming a case with polygonal section from a blank of sheet material. There is an assembly of panels. The assembly of panels is wound about a mandrel with polygonal section. The tongue is fixed to the free edge of the endmost panel. The flaps situated on the same side of the panels are folded. The flaps thus folded are fixed together.

12 Claims, 7 Drawing Sheets

1
2
3
4
5
6
7
8
9
10
11.2
11.3
11.4
11.5
12.2
12.3
12.4
12.5
13.2
13.3
13.4
13.5
14.2
14.3
14.4
14.5
16
17
18
19
20
21

METHOD AND MACHINE FOR FORMING CASES WITH POLYGONAL SECTION MADE FROM A SHEET MATERIAL AND CASES THUS OBTAINED

BACKGROUND OF THE INVENTION

1. Field of the Invention

The present invention relates to a method and machine for forming cardboard, corrugated cardboard or similar sheet material cases, having a polygonal section and particularly a square or rectangular section.

2. Description of the Prior Art.

Cases of this type are formed from a single blank of said sheet material, comprising an assembly of panels (at least three) connected together by parallel fold-lines and provided laterally with flaps, connected respectively to said panels by fold-lines perpendicular to the fold-lines connecting said panels together and intended to form the bottom and the lid of said cases. The free edge of one of the endmost panels of said assembly is provided with a tongue connected to said endmost panel by a fold-line parallel to those connecting said panels together and intended to be fixed against the free edge of the opposite endmost panel.

Known cases of this type are called "American" and they have a square or rectangular section (transversely to said boards). They are manufactured by an industrial cardboard maker who, from said blank forms a flattened tubular blank by folding said blank about the median fold-line of said assembly of panels and fixing said tongue to the opposite endmost panel. At that time, said model has then a section in the form of a flattened parallelogram, said lateral flaps extending the corresponding panels respectively outwardly. Then, these flattened blanks are delivered to the user who, in order to house therein objects to be packed, puts them into shape by expansion parallel to the flattened diagonal of said parallelogram then folds back and glues said flaps so as to form the bottom and, after filling, the lid of said case.

Such a procedure for manufacturing and use has numerous drawbacks; In fact:

of course, both manufacture of the flattened blank by the cardboard maker and the shaping of said blanks by the user are achieved by means of automatic machines. It can then be seen that it is necessary to use two complex and so expensive automatic machines, which adds to the cost of using said cases.

bacause of the lateral flaps, it is difficult to strictly guide the edges of the blank at the moment of fixing the tongue on the opposite endmost panel, so that squaring is poor and the bonding line obtained is not strictly parallel to the fold-lines joining said flaps together; the section of the case is therefore not strictly identical between the bottom and the lid and the result is defects in the presentation of the cases, which adversely affects the quality thereof.

the flattened blanks have an extra thickness in the middle since the flattened blank comprises locally three thicknesses instead of two. This extra thickness results in unbalancing the stacks of blanks formed for storage and transporting said blanks. The result is difficulties in handling said stacks.

because of the above mentioned extra thicknesses, the number of flattened blanks which can be housed in the feed magazine of the shaping and filling machine on the user's premises is limited.

the intermediate fold-lines of the panels are bent to a maximum during formation of the flattened blanks; in addition, the intermediate fold-lines form external edges of said blanks. Consequently, they are weakened by flattening the blanks and subject to external aggressions. The result is that these intermediate fold-lines form lines of lesser strength for said cases.

the boards of said cases are necessarily four in number and identical two by two, because of inaccuracies in fixing and because the edges are made fragile, it is necessary to use high quality sheet material. The cost of said cases is therefore high.

SUMMARY OF THE INVENTION

The purpose of the present invention is to overcome these drawbacks. It makes it possible to form a case of the above type completely directly from the blank of sheet material, without passing through the intermediate stage of forming the flattened blank. Thus, the present invention makes it possible:

to suppress the automatic machine for folding and bonding the flattened models on the cardboard maker's premises, to store and transport said blanks in the flat condition, so that the drawbacks due to the above mentioned extra thicknesses is eliminated, namely the difficulties of handling and limitations in supplying the user machine (in fact, the capacity of the magazine thereof is multiplied by three, for equal height); the machine has then a much longer independent operating time, from the foregoing, it follows that the intermediate fold-lines are no longer lines of weakness, to manufacture cases having any number of panels (at least three) and whose boards may have different widths;

to manufacture high quality cases in so far as squaring and the strictness of the inner dimension is concerned, even with lower quality sheet materials.

For this, in accordance with the invention, the method for forming a polygonal section case from a sheet material blank comprising an assembly of panels connected to each other by parallel fold-lines and provided with lateral flaps, connected respectively to said panels by fold-lines perpendicular to the fold-lines connecting said panels together and intended to form respectively the bottom and the lid of said case, the free edge of one of the endmost panels of said assembly of panels being provided with a tongue connected to said endmost panel by a fold-line parallel to the fold-lines connecting said panels together is remarkable in that:

said assembly of panels is wound on a mandrel with polygonal section, whose external section corresponds to the inner section of said case to be obtained, so that each of the panels is applied against a face of said mandrel and so that said fold-lines connecting the panels together bear against a corresponding edge of said mandrel, said tongue is fixed to the free edge of the other one of said endmost boards of said assembly of boards, the flaps situated on the same side of said panels are folded down against a corresponding face of said mandrel, about corresponding fold-lines which are in correspondence with edges of said mandrel, and said flaps are fixed together.

Thus, with the invention, the case may be formed from said blank at the moment when it is desired to use it, e.g. for packing a product.

In an advantageous embodiment, said mandrel is disposed in a fixed station and said blank is brought to said mandrel by a translational movement, in a direction parallel to said fold-lines connecting said panels together.

In addition, it is preferable, during winding of said assembly of panels about the mandrel and folding of said flaps thereon, for at least one of said panels to be horizontal. Thus, it may rest on a table disposed under said mandrel. It is then advantageous for the direction of the translational movement bringing said blank to be also horizontal, so that the blank may be brought to said mandrel and positioned thereunder by simple sliding over the table.

In order to avoid the drawbacks of a fault in the accurate positioning of the blank with respect to the mandrel, which could possibly cause the blank to be folded along lines different from the pre-formed fold-lines, it is advantageous, for winding said assembly of panels about said mandrel, to place an intermediate panel of said assembly of panels at least approximately opposite the corresponding face of said mandrel, but at some distance therefrom, then to fold the panels adjacent said intermediate panel and to bring said intermediate panel towards said corresponding face. Thus, a possible shift between the blank and the mandrel can be compensated for.

Moreover, particularly for removing the blank from the mandrel, the face of the mandrel against which said flaps are folded is made movable.

Said tongue may be fixed to the free edge of said other endmost board and/or said flaps may be fixed together by glueing.

The present invention also provides a machine for forming a case with polygonal section from a sheet material blank comprising an assembly of panels joined together by parallel fold-lines and having lateral flaps connected respectively to said panels by fold-lines perpendicular to the fold-lines connecting said panels together and intended to form respectively the bottom and the lid of said case, the free edge of one of the endmost boards of said assembly of panels being provided with a tongue connected to said endmost panel by a fold-line parallel to the fold-lines connecting said panels together, this machine being remarkable in that it comprises a mandrel with polygonal section whose external section corresponds to the inner section of the case to be obtained, means for winding said assembly of boards about said mandrel so that each of said panels is applied against a face of said mandrel and so that said fold-lines connecting said panels together bear against a corresponding edge of said mandrel, means for fixing said tongue to the free edge of the other one of said endmost panels of said assembly of boards, means for folding the flaps situated on the same side of said panels against a corresponding face of said mandrel, about corresponding fold-lines which are in correspondence with edges of said mandrel, and means for fixing together said flaps thus folded.

Preferably, the machine of the invention comprises a horizontal table disposed under said mandrel and means for bringing said blank under said mandrel, by sliding over said table, as well as means for locally glueing said blank when it is brought under the mandrel.

It is advantageous for it to comprise means for placing said case upright for its removal. The machine may comprise means for ejecting the case from the mandrel, formed at least partially by said face of the mandrel against which said flaps are folded.

In an advantageous embodiment, in the machine of the invention, said means for winding said panels about the mandrel comprise a mobile assembly, having fixed stops and swinging arms.

BRIEF DESCRIPTION OF THE DRAWINGS

The figures of the accompanying drawings will better show how the invention may be implemented. In these figures, identical references designate similar elements.

Figure 3:
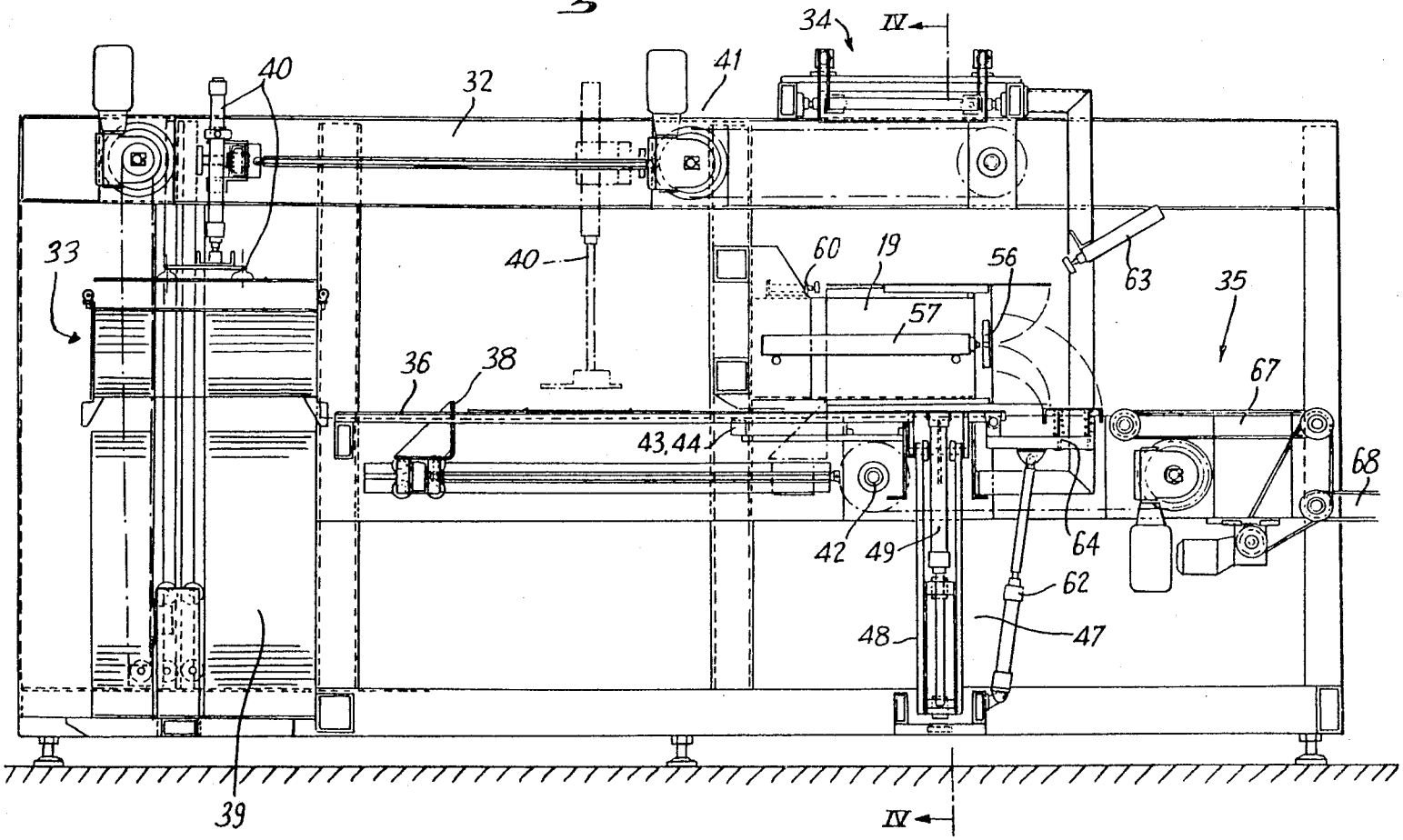
FIG. 3 is a longitudinal sectional view of a machine according to the invention.
Figure 4:
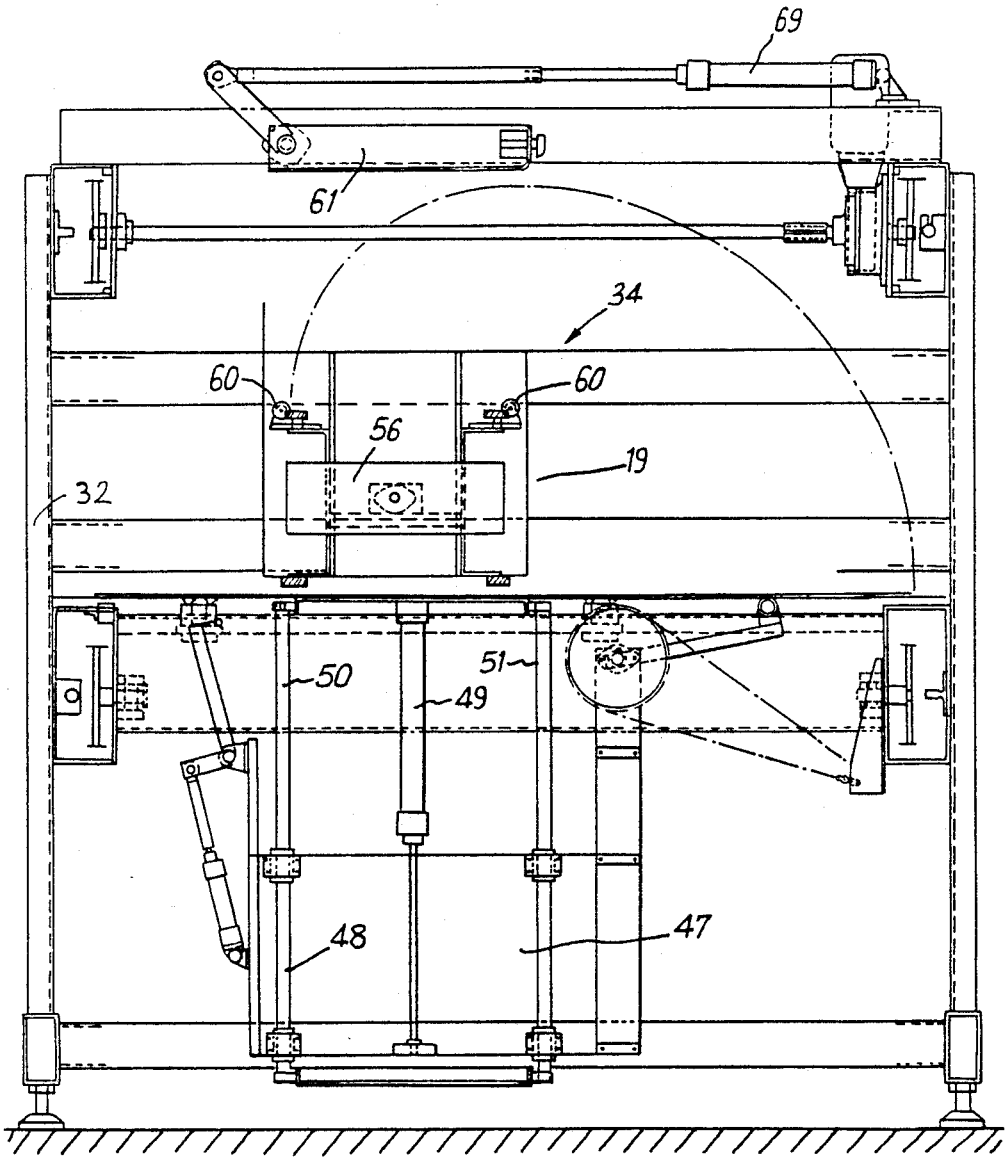
FIG. 4 is a cross sectional view through line IV—IV of FIG. 3.
Figure 5:
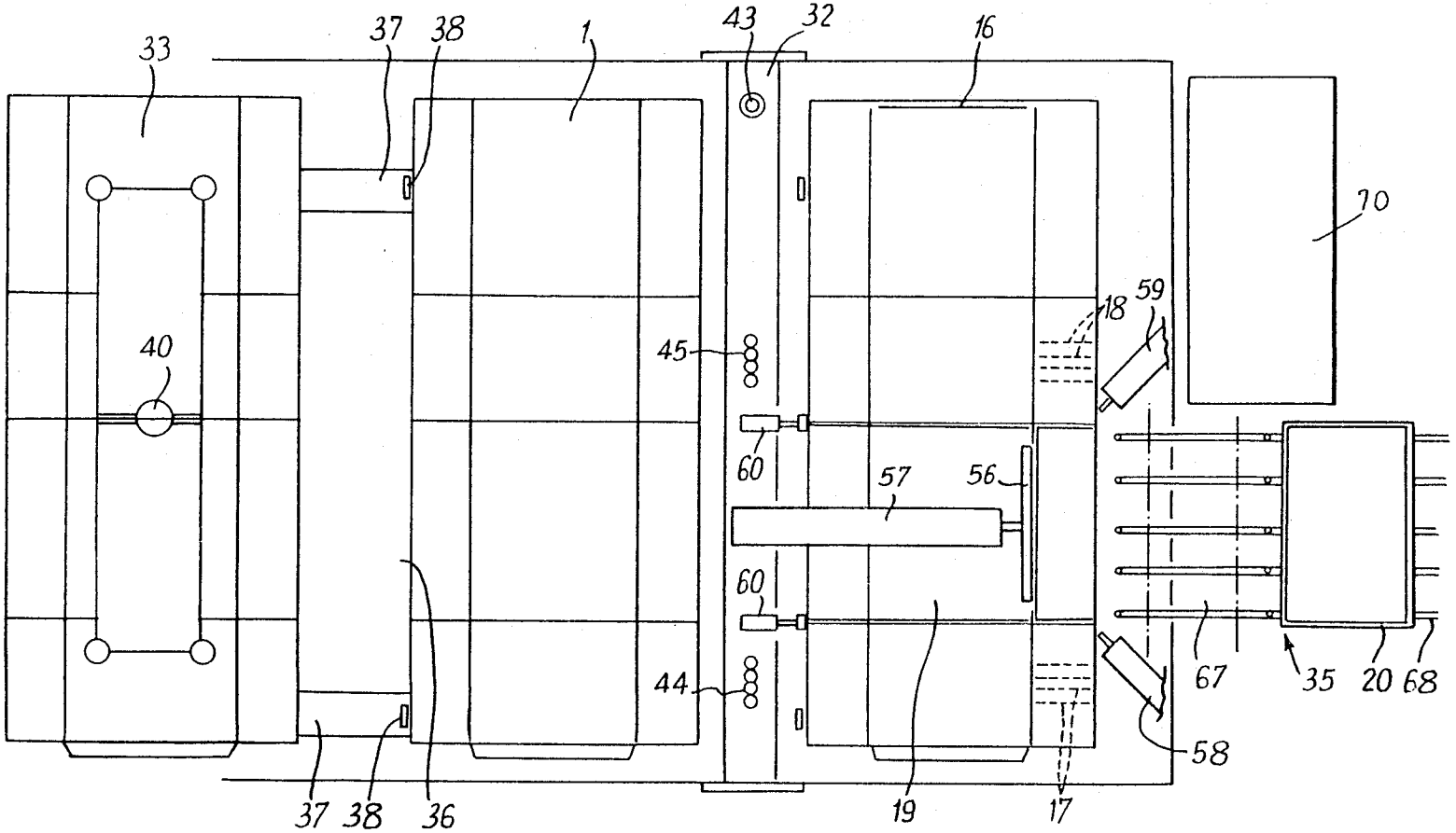
FIG. 5 is a schematic and partial top view of the machine of FIGS. 3 and 4.
Figure 6:
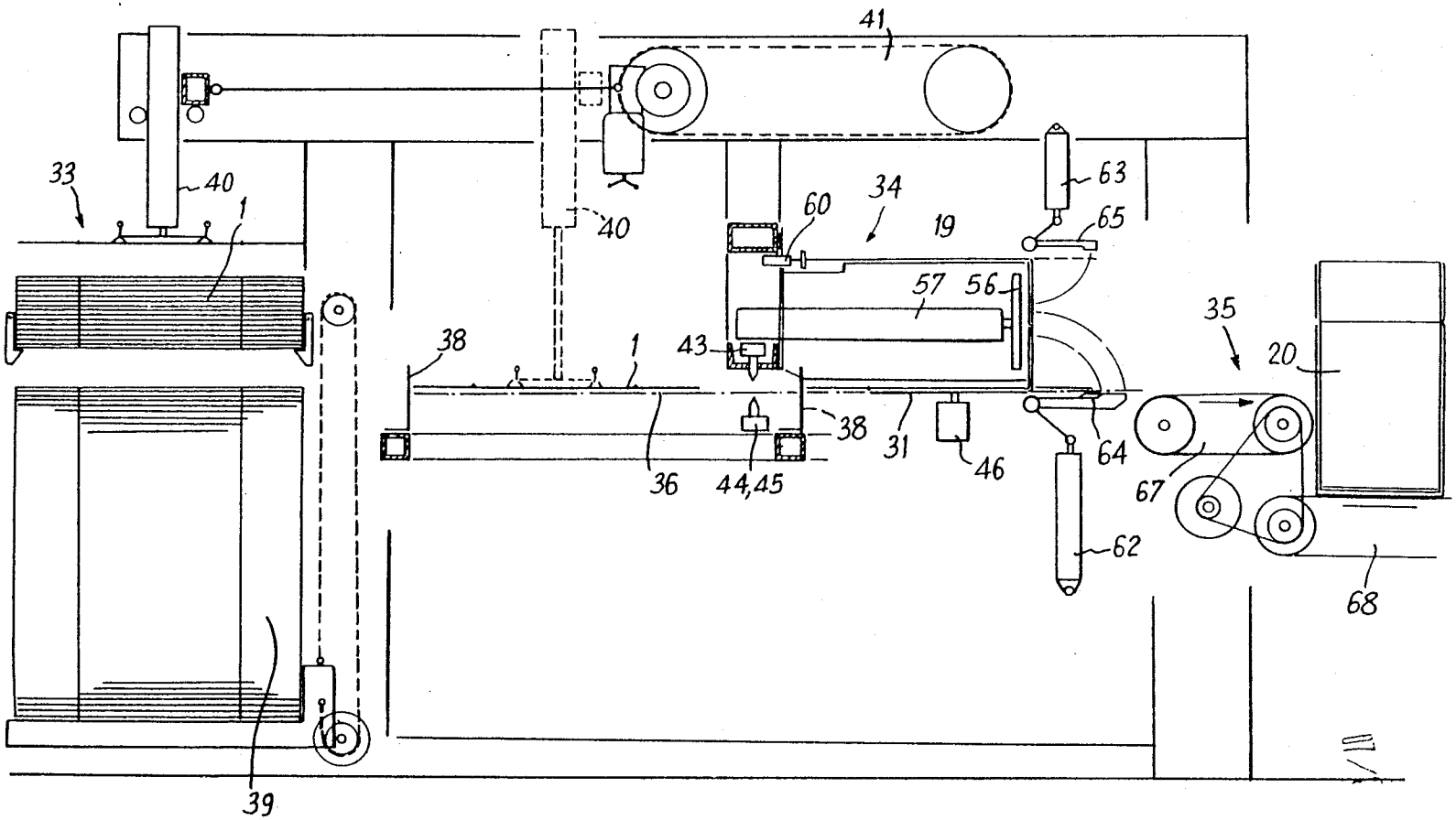
FIG. 6 is a schematic, partial and simplified view corresponding to the longitudinal section of FIG. 3, FIGS. 7 and 8 are schematic, partial and simplified views corresponding to the cross section of FIG. 4.
Figure 7:
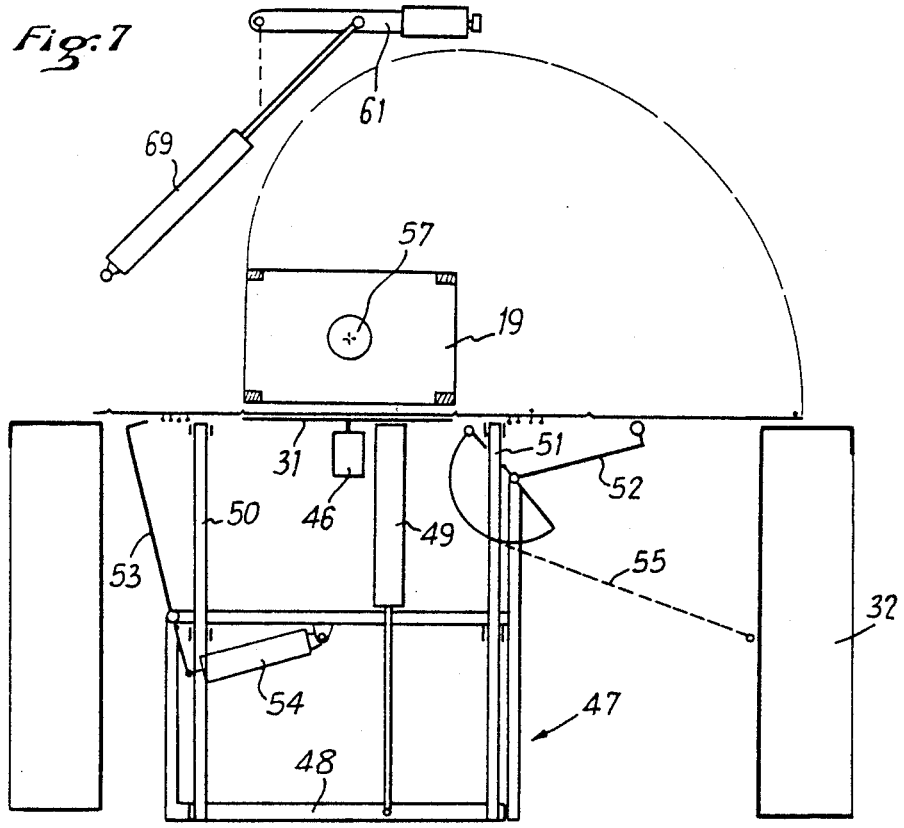
Figure 8:
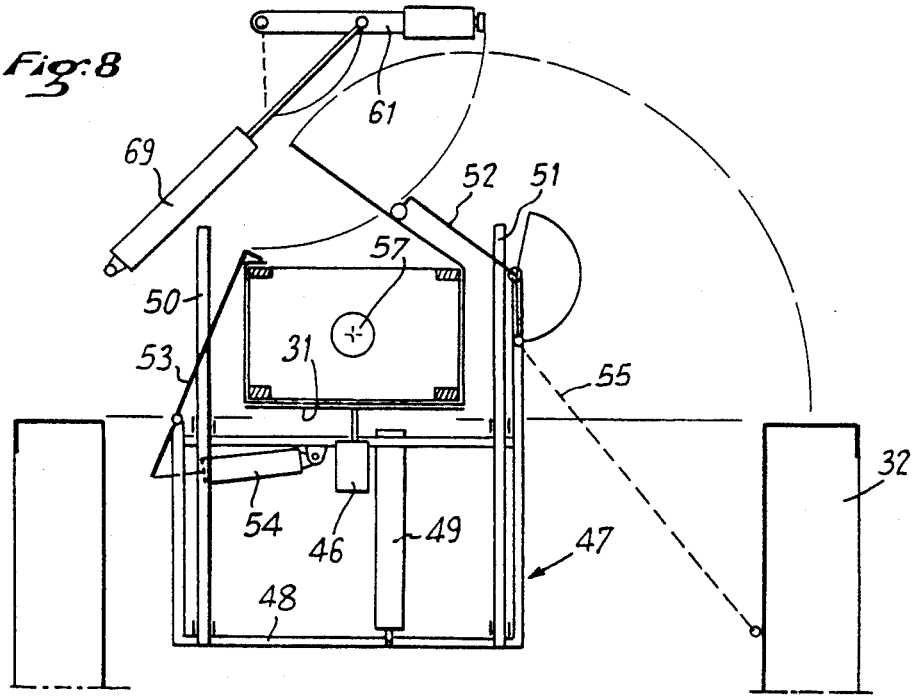

The schematic, partial and simplified views of FIGS. 6, 7 and 8 are intended to illustrate the operation of the machine of FIGS. 3 and 4. For the sake of clearness, they each comprise only a part of the elements of said machine.

DESCRIPTION OF THE PREFERRED EMBODIMENT

Figures 1A, 1B, 1C, 1D:
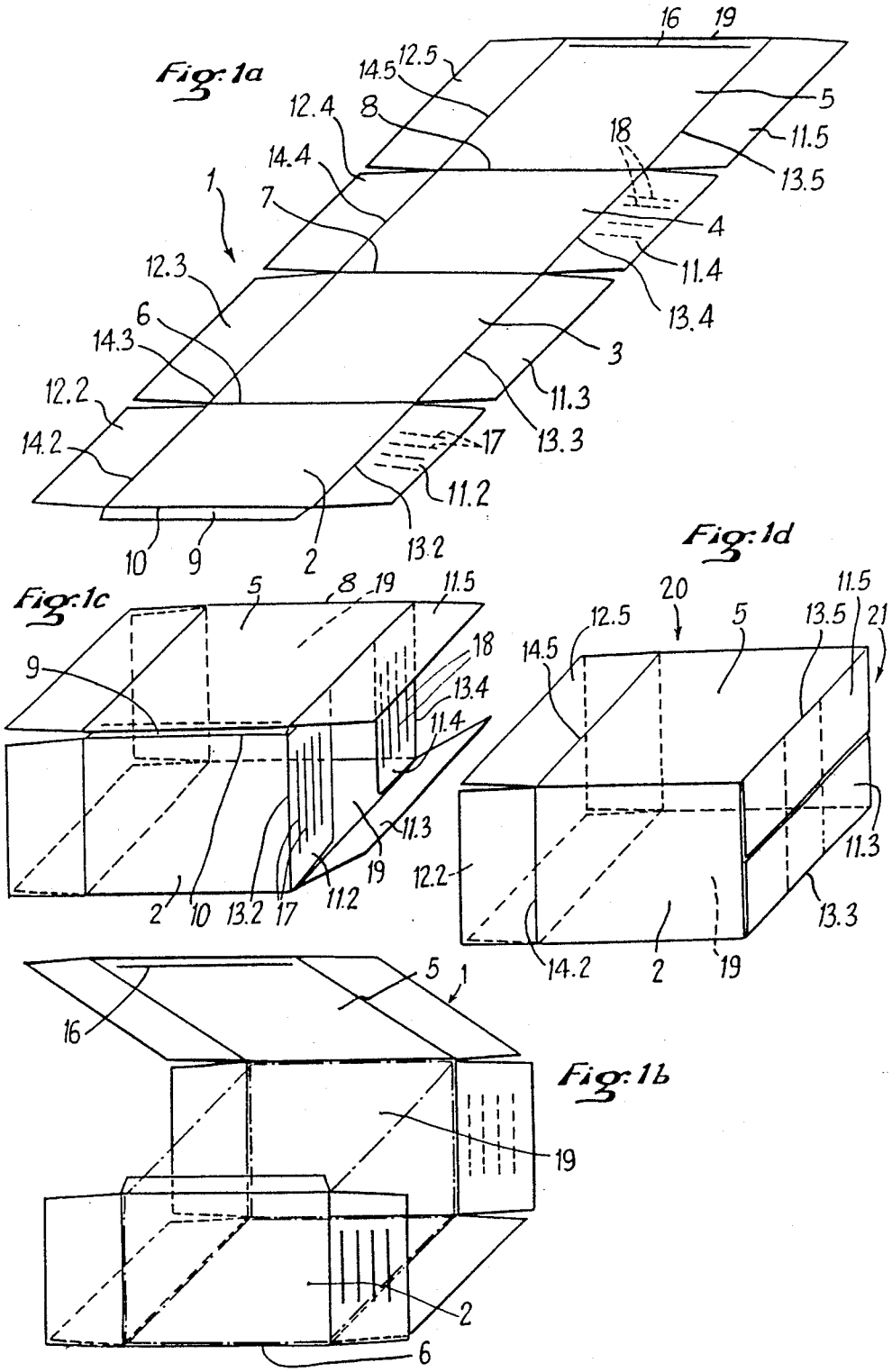
FIGS. 1*a*, 1*b*, 1*c* and 1*d* illustrate the method of the invention for forming a case, applied to a particular embodiment of such a case.

The sheet material blank, made for example from cardboard or corrugated cardboard, shown in FIG. 1*a* comprises an assembly of four aligned panels 2, 3, 4 and 5, connected together two by two by pre-formed and parallel fold-lines 6, 7 and 8. These parallel fold-lines 6, 7 and 8 are disposed respectively between panels 2 and 3, 3 and 4, 4 and 5. Along the free edge of the endmost panel 2 of said assembly of panels 2 to 5 is disposed a tongue 9, connected to said endmost panel 2 by a fold-line 10, parallel to fold-lines 6, 7 and 8.

Furthermore, on each side of each panel 2 to 5 are provided flaps 11.2, 11.3, 11.4, 11.5 and 12.2, 12.3, 12.4, 12.5. Each side flap 11.2 to 11.5 is hinged to the corresponding panel 2 to 5 by a pre-formed fold-line 13.2 to 13.5. The fold-lines 13.2 to 13.5 are aligned and are perpendicular to the fold lines 6, 7 and 8. Similarly, each side flap 12.2 to 12.5 is hinged to the corresponding panel 2 to 5 by a pre-formed fold-line 14.2 to 14.5. The fold-lines 124.2 to 14.5 are aligned and perpendicular to the fold-lines 6, 7 and 8.

Lines of adhesive 16, 17 and 18 are deposited both on the upper face (with respect to FIG. 1*a*) of the endmost panel 5, along the free edge 19 thereof and on the lower face (with respect to FIG. 1*a*) of flaps 11.2 and 11.4.

According to the invention (see FIG. 1*b*) a mandrel 19 is provided whose external shape corresponds to the internal shape of the case to be obtained from blank 1. Such a mandrel may be solid or formed solely of a frame defining its edges.

Blank 1 is disposed with respect to mandrel 19 so that its board 3 is applied against the corresponding lower face of the mandrel, then panels 2 and 4 are folded about the edges thereof corresponding to fold-lines 6 and 7, so as to be applied against the corresponding said faces of the mandrel 19 (see FIG. 1*b*). After, that panel 5 and tongue 9 are folded respectively about the edges of said mandrel corresponding respectively to the fold-lines 8 and 9, so as to be applied on the upper face of said mandrel 19, tongue 9 being under panel 5 (see FIG. 1*c*). A pressure exerted on board 5 applies edge 19 thereof on said tongue so that, with the line of adhesive 16, panel 5 and tongue 9 are joined together. In addition, flaps 11.2 and 11.4 are folded about the edges of the mandrel 19 corresponding respectively to the fold-lines 13.2 and 13.4 so as to be applied against the corresponding side face of mandrel 19 (see also FIG. 16).

In this position, the lines of adhesive 17 and 18 are directed outwardly.

Finally, flaps 11.3 and 11.5 are folded about the edges of mandrel 19 corresponding respectively to the fold-lines 13.3 and 13.5 and are applied against the flaps 11.2 and 11.4, already folded, so that said flaps 11.2 to 11.5 are joined together, because of the lines of adhesive 17 and 18 (see FIG. 1*d*). Then the case 20 shown in FIG. 1*d* is obtained, resting on panel 3 and open on the side of flaps 12.2 to 12.5.

For filling this case 20, it is released from mandrel 19 and it may be placed upright so as to rest on its bottom 21 formed by flaps 11.2 to 11.5 joined together. After filling, the case 20 may be closed by folding flaps 12.2 to 12.5 respectively about fold-lines 14.2 to 14.5, then flaps 12.2 to 12.5 may be joined together for example by glueing.

Figure 2A:
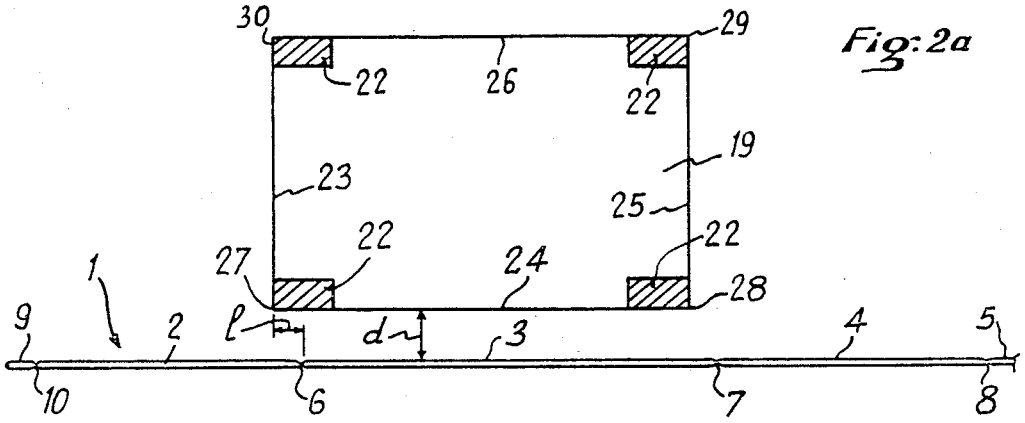
FIGS. 2*a*, 2*b* and 2*c* show schematically the transverse positioning of a blank with respect to the mandrel.
Figure 2B:
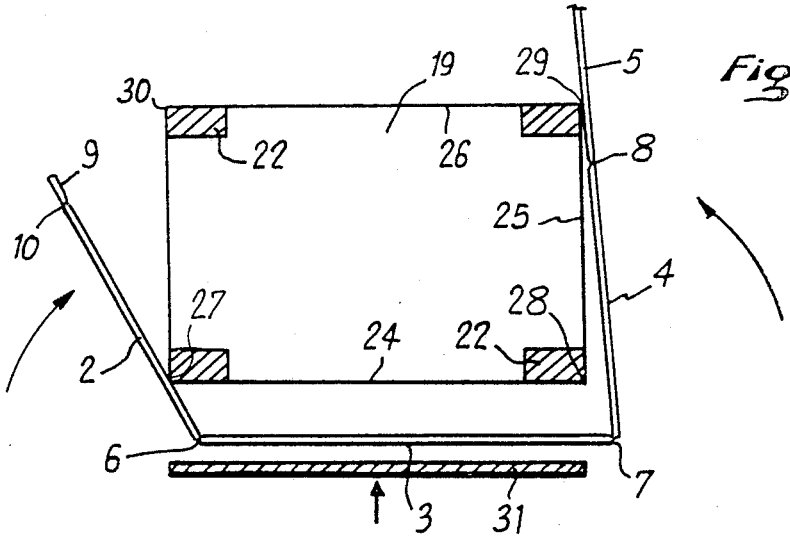
Figure 2C:
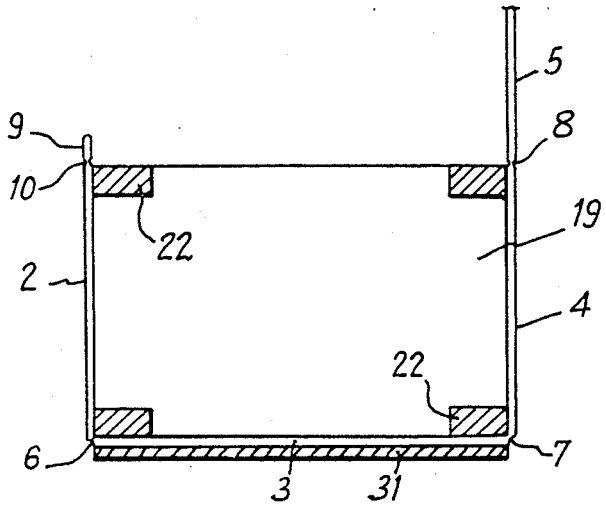

In FIGS. 2*a* to 2*c*, the procedure has been illustrated for positioning blank 1 with respect to the mandrel, when it is desired to apply board 3 against the corresponding lower face of mandrel 19. In these figures, it has been assumed that mandrel 19 was formed on bars 22 (seen in section), parallel and with rectangular sections, defining virtual bearing faces 23 to 26, respectively for panels 2 to 5, as well as folding edges 27 to 30 corresponding respectively to the fold-lines 6, 7, 8 and 10.

A blank 1 is brought in the vicinity of mandrel 19, so that its panel 3 is disposed facing the bearing face 24.

Although it is desirable for the lateral positioning of said board 3 with respect to face 24 to be as accurate as possible, it may happen that a lateral shift 1 appears between panel 3 and said bearing face 24. To avoid untimely folding of blank 1, outside the fold-lines 6 and 7, during folding of panels 2 and 4, before folding said panels 2 and 4, panel 3 is moved away from the bearing face 24 by a distance d (see FIG. 2*a*). Then, during folding of said panels 2 and 4, panel 3 is brought close to the bearing face 24 by means of a plate 31, preferably exactly superimposable on said bearing face 24. Thus, while panel 3 is brought close to face 24, panels 2 and 4 bear against the mandrel 19 (see FIG. 2*b*) which generates a guiding effect and positions panel 3 exactly with respect to the bearing face 24. When plate 31 presses panel 3 against the bearing face 24, the fold-lines 6 and 7 are exactly superimposed on the folding edges 27 and 28 so that, after final folding of flaps 2 and 4, respectively against the bearing faces 23 and 25, the fold-lines 8 and 10 are also exactly superimposed on the folding edges 29 and 30 (see FIG. 2*c*).

The machine of the present invention, shown in FIGS. 3 to 8, comprises a frame 32 with respect to which are disposed a station 33 for supplying blanks, a station 34 for shaping said blanks about said mandrel 19 and a station 35 for removing the finished cases 20. Between the supply station 33 and the shaping station 34 is disposed a horizontal table 36, provided with longitudinal slits 37 through which drive fingers 38 may pass.

The supply station 33 comprises a magazine 39 containing a stack of blanks 1, as well as means 40 for taking the upper blank 1, e.g. by suction, from said stack of blanks. Said taking means 40 are movable under the action of drive means 41 for successively taking the blanks 1 from magazine 39 and depositing them on table 36, upstream of the shaping station 34. Then the drive fingers 38, driven by a drive means 42, cause blank 1 thus taken and placed to slide over table 36 so as to bring it under the mandrel 19 of the shaping station 34.

During transfer to the shaping station 34, blank 1 meets glue applicators 43, 44 and 45, fixed to frame 32, and depositing respectively the lines of adhesive 16, 17 and 18.

Thus, because of the drive fingers 38 and the glue applicators 43 to 45, blank 1 is disposed, already glued, under mandrel 19 in the position shown in FIG. 2*a*, above the pressure plate 31, driven by a jack 46.

To fold panels 2 and 4, the shaping station 34 comprises the mechanism 47, shown in FIGS. 3, 4, 7 and 8. This mechanism 47 comprises a mobile assembly 48 which can be raised or lowered by means of a jack 49, bearing on frame 32.

The mobile assembly 48 comprises two stops 50 and 51, capable of folding panel 2 and 4, respectively against the bearing faces 23 and 25 of mandrel 19 (see also FIG. 2*b*) when the mobile assembly 48 is brought close to mandrel 19.

In addition, said mobile assembly 48 comprises hinged arms 52 and 53 for folding panel 5 and tongue 9 respectively against the face 26 of mandrel 19 after panels 2 and 4 have been folded between the bearing faces 23 and 25. For example, arm 52 is driven by a jack 54 whereas arm 53 is actuated by a linkage 55, connected to frame 32.

Inside mandrel 19 is disposed a transverse plate 56, serving as end face to said mandrel 19 and driven by a jack 57.

Actuators 58 and 59, such as jacks for example, may fold flaps 11.2 and 11.4 respectively against plate 56.

After action of stops 50 and 51, arms 52 and 53 and actuators 58 and 59, the blank is in the state shown in FIG. 1*c*.

At this time, in order to improve squaring of shaped blank 1 before final glueing, a longitudinal pressure may be exerted thereon, by means of jacks 60 pressing it in the direction of actuators 58 and 59 bearing on the free edge of flaps 12.2, 12.4 and 12.5.

After squaring, panel 5 is applied against the bearing face 26 by an arm 61 swinging under the action of a jack 69. Panel 5 is then joined to tongue 9 by means of the line of adhesive 16.

Finally, jacks 62 and 63, possibly via pivoting plates 64 and 65, apply flaps 11.3 and 11.5 against flaps 11.2 and 11.4, previously folded against plate 56. Thus, said flaps 11.2 to 11.5 are joined together by means of the lines of adhesive 17 and 18, to form bottom 21. The case is then as shown in FIG. 1*d*.

The removal station 35 comprises two staircase conveyors 67 and 68, so that when case 20 is discharged from the mandrel 19 by action of jack 57, it is tipped from conveyor 67 to conveyor 68 and is discharged thereby, on which it rests on its bottom 21.

A cabinet 70 contains the means for controlling and synchronizing the different members of the above defined machine.

What is claimed is:

1. A method for forming a carton with polygonal section from a blank having a plurality of side wall panel elements (2 to 5) delineated by first bending lines (6 to 8) parallel to each other, including two end side wall panel elements (2 and 5) and at least one intermediate side wall panel element (3), and side flaps (11.2 to 11.5) intended to form the bottom of said carton and respectively connected to said side wall panel elements (2 to 5) by second bending lines (13.2 to 13.5) perpendicular to said first bending lines (6 to 8), the free edge of one of said end side wall panel element (2) of said blank having a tongue (9) connected to said one end side wall panel element (2) by a third bending line (10) parallel to said first bending lines (6 to 8), comprising the steps of:

providing a mandrel (19) having an external section corresponding to the inner section of said carton and lateral faces (23 to 26) respectively corresponding to said end and intermediate side wall panel elements (2 to 5);

placing said intermediate side wall panel element (3) approximately opposite the corresponding lateral face (24) of said mandrel (19), but at some distance (d) from said corresponding face (24);

folding said side wall panel elements (2 and 4) respectively adjacent to said intermediate side wall panel element (3) around the respective first bending lines (6 and 7) joining the respective said adjacent sidewall panel elements to said intermediate sidewall panel element, in such a way that said adjacent side wall panel elements (2 and 4) or other (5) side wall panel elements connected to said adjacent side wall panel elements bear against said mandrel (19);

pushing said intermediate side wall panel element (3) toward said corresponding face (24) of said mandrel, while maintaining said adjacent side wall panel elements or said other side wall panel elements in contact against said mandrel (19) and making free said intermediate side wall panel element (3) to shift in a direction parallel to said corresponding face of said mandrel and perpendicular to said first bending lines, so that said adjacent or other side wall panel elements assist in aligning said intermediate side wall panel element with said corresponding face of said mandrel;

pressing said intermediate side wall panel element (3) against said corresponding lateral face (24);

winding said blank around said mandrel so that each of the side wall panel elements is applied against the respective corresponding lateral face of said mandrel and so that said first bending lines bear against respective edges of said mandrel;

fixing said tongue to said other end side wall panel element (5); and folding said side flaps (11.2 to 11.5) and fixing them together for forming the bottom of said carton.

2. The method as claimed in claim 1 wherein said mandrel (19) has an end face (56) and said side flaps (11.2–11.5) are folded towards said end face and then pressed against said end face while fixing them together.

3. The method as claimed in claim 2 wherein said end face (56) is movable.

4. The method as claimed in claim 1 wherein said mandrel is disposed in a fixed station and said blank is brought to said mandrel by a translational movement, in a direction parallel to said first bending lines.

5. A machine for forming a carton with polygonal section from a blank having a plurality of side wall panel elements (2 to 5) delineated by first bending lines (6 to 8) parallel to each other, including two end side wall panel elements (2 and 5) and at least one intermediate side wall panel element (3), and side flaps (11.2 to 11.5) intended to form the bottom of said carton and respectively connected to said side wall panel elements (2 to 5) by second bending lines (13.2 to 13.5) perpendicular to said first bending lines (6 to 8), the free edge of one of said end side wall panel element (2) of said blank having a tongue (9) connected to said one end side wall panel element (2) by a third bending line (10) parallel to said first bending lines (6 to 8) comprising:

a mandrel (19) having an external section corresponding to the inner section of said carton and lateral faces (23 to 26) respectively corresponding to said end and intermediate side wall panel elements (2 to 5);

means for placing said intermediate side wall panel element (3) approximately opposite the corresponding lateral face (24) of said mandrel (19), but at some distance (d) from said corresponding face (24);

means for folding said side wall panel elements (2 and 4) respectively adjacent to said intermediate side wall panel element (3) around the respective first bending lines (6 and 7) joining the respective said adjacent sidewall panel elements to said intermediate sidewall panel element, in such a way that said adjacent side wall panel elements (2 and 4) or other (5) side wall panel elements connected to said adjacent side wall panel elements bear against said mandrel (19);

a pushing plate (31) corresponding to said intermediate side wall panel element (3);

means for pushing said intermediate side wall panel element (3) toward said corresponding face (24) of said mandrel by means of said pushing plate (31) and means for maintaining said adjacent side well panel elements or said other side wall panel elements in contact against said mandrel (19) and making free said intermediate side wall panel element (3) to shift in a direction parallel to said corresponding face of said mandrel and perpendicular to said first bending lines, so that said adjacent or other side wall panel elements assist in aligning said intermediate side wall panel element with said corresponding face of said mandrel, said means for pushing also being for pressing said intermediate side wall panel element (3) against said corresponding lateral face (24) by means of said pushing plate (31);

means for winding said blank around said mandrel so that each of the side wall panel elements is applied against the corresponding face of said mandrel and so that said first bending lines bear against an edge of said mandrel;

means for fixing said tongue to said other end side wall panel element (5);

means for folding said side flaps and for fixing them together for forming the bottom of said carton; and means for ejecting said carton from said mandrel.

6. The machine as claimed in claim 5 wherein said mandrel has an end face against which said side flaps are pressed by said means for folding said flaps and for fixing them together.

7. The machine as claimed in claim 6 wherein said end face of said mandrel is movable.

8. The machine as claimed in claim 7 wherein said movable end face of said mandrel forms at least partially said means for ejecting said carton from said mandrel.

9. The machine as claimed in claim 5 comprising a horizontal table disposed under said mandrel and means for bringing said blank under said mandrel by sliding over said table.

10. The machine as claimed in claim 5 comprising means for locally coating said blank with glue when it is brought under said mandrel.

11. The machine as claimed in claim 5 comprising means for vertically setting the carton upright after ejection from said mandrel.

12. The machine of claim 5 wherein said means for winding said blank around said mandrel comprise a mobile assembly with fixed stops and swinging arms.

* * * * *